US006597373B1

(12) United States Patent
Singla et al.

(10) Patent No.: US 6,597,373 B1
(45) Date of Patent: Jul. 22, 2003

(54) SYSTEM AND METHOD OF ALIGNING IMAGES FOR DISPLAY DEVICES

(75) Inventors: Ashutosh Singla, Fair Oaks, CA (US); Richard W. Jensen, Fair Oaks, CA (US); Kim A. Meinerth, Granite Bay, CA (US); Paul A. Jolly, Cameron Park, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/478,993

(22) Filed: Jan. 7, 2000

(51) Int. Cl.[7] ..... G09G 5/00
(52) U.S. Cl. ..... 345/698; 345/100; 345/213
(58) Field of Search ..... 345/87–104, 204, 345/213, 214, 660, 661, 667, 698, 699; 348/556

(56) References Cited

U.S. PATENT DOCUMENTS 5,448,260 A * 9/1995 Zenda et al. ..... 345/100
5,592,194 A * 1/1997 Nishikawa ..... 345/667
5,696,527 A * 12/1997 King et al. ..... 345/634
5,748,175 A * 5/1998 Shimada et al. ..... 345/660
5,844,539 A * 12/1998 Kitagawa ..... 345/100
5,874,937 A * 2/1999 Kesatoshi ..... 345/428
6,067,071 A * 5/2000 Kotha et al. ..... 345/213
6,236,388 B1 * 5/2001 Iida et al. ..... 345/100
6,295,048 B1 * 9/2001 Ward et al. ..... 345/699

* cited by examiner

*Primary Examiner*—Bipin Shalwala
*Assistant Examiner*—Mansour M. Said
(74) *Attorney, Agent, or Firm*—Sharon Wong

(57) ABSTRACT

A display controller that includes a controller adapted to receive images selectable in real-time to any of a two or more of differing scanning resolutions, adapted to receive information regarding a fixed scanning resolution of a display device, and adapted to generate image borders taking into consideration the information of the fixed scanning resolution and a currently selected one of the two or more differing scanning resolutions, in order to control placement of the images on the display device.

25 Claims, 5 Drawing Sheets

SYSTEM AND METHOD OF ALIGNING IMAGES FOR DISPLAY DEVICES

FIELD

The invention generally relates to computer graphics and in particular to a system and method of aligning images for display devices.

BACKGROUND

The Video Graphics Array (VGA) is the established color graphics card of choice for the Personal Computer (PC) family of computers. Millions of Enhanced Graphics Array (EGA) and VGA cards are in use worldwide. VGA controllers have penetrated every PC platform, from laptops through workstations. The Super VGA (SVGA) standard, an extension of the original VGA, offers new and more powerful graphics features. Software applications using VGA and SVGA have expanded from the early illustration and graphics packages to include workstation resolution computer aided design (CAD), desktop publishing, image processing, animation, and multimedia presentation systems.

VGA cards are controlled by a register set, referred to herein as the VGA registers. The VGA register set was published early on, and programs were allowed to write to the registers at will. This allows programs to control the VGA card's mode of operation. These programs may change the VGA mode one or more times during operation of the program.

Multi-sync monitors are designed to display images for all VGA modes of operation. Each VGA mode might have a different resolution and timing. Multi-sync monitors have built-in scalars and timing phase-locked-loops (PLLs) that lock to whatever output mode the graphics card is in. The scalar scales the image to fit the screen, and the PLL locks to the VGA timing. These displays therefore are able to adapt whenever a program might change the VGA mode and to display a correctly scaled and aligned image.

Some display devices, however, operate on a fixed timing and resolution and are unable to lock to a different timing or scale the image to fit the resolution of the display. Many flat panel displays and televisions have these fixed requirements. If the VGA controller were allowed to drive these displays without additional processing, then the VGA image would (at best) not be aligned properly when displayed on the display device. For these displays to be compatible with legacy VGA software, the display controller must bridge the gap between the VGA mode and the fixed timing expected by the display.

One approach to handling this problem is for display controllers to determine the VGA mode by counting the pixels and lines output by the VGA timing generator, and then adjusting the output to the display accordingly so that the VGA image is properly aligned. However, it sometimes takes multiple frames before the mode may be determined, and in the interim the image will not be displayed properly. This effect may become particularly bothersome if the VGA software changes modes frequently.

Therefore, a need exists for an improved system and method for aligning a VGA image for display on a fixed-resolution display device.

BRIEF DESCRIPTION OF THE DRAWING(S)

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and the invention is not limited thereto. The spirit and scope of the present invention are limited only by the terms of the appended claims.

The following represents brief descriptions of the drawings, wherein.

DETAILED DESCRIPTION

Figure 1:
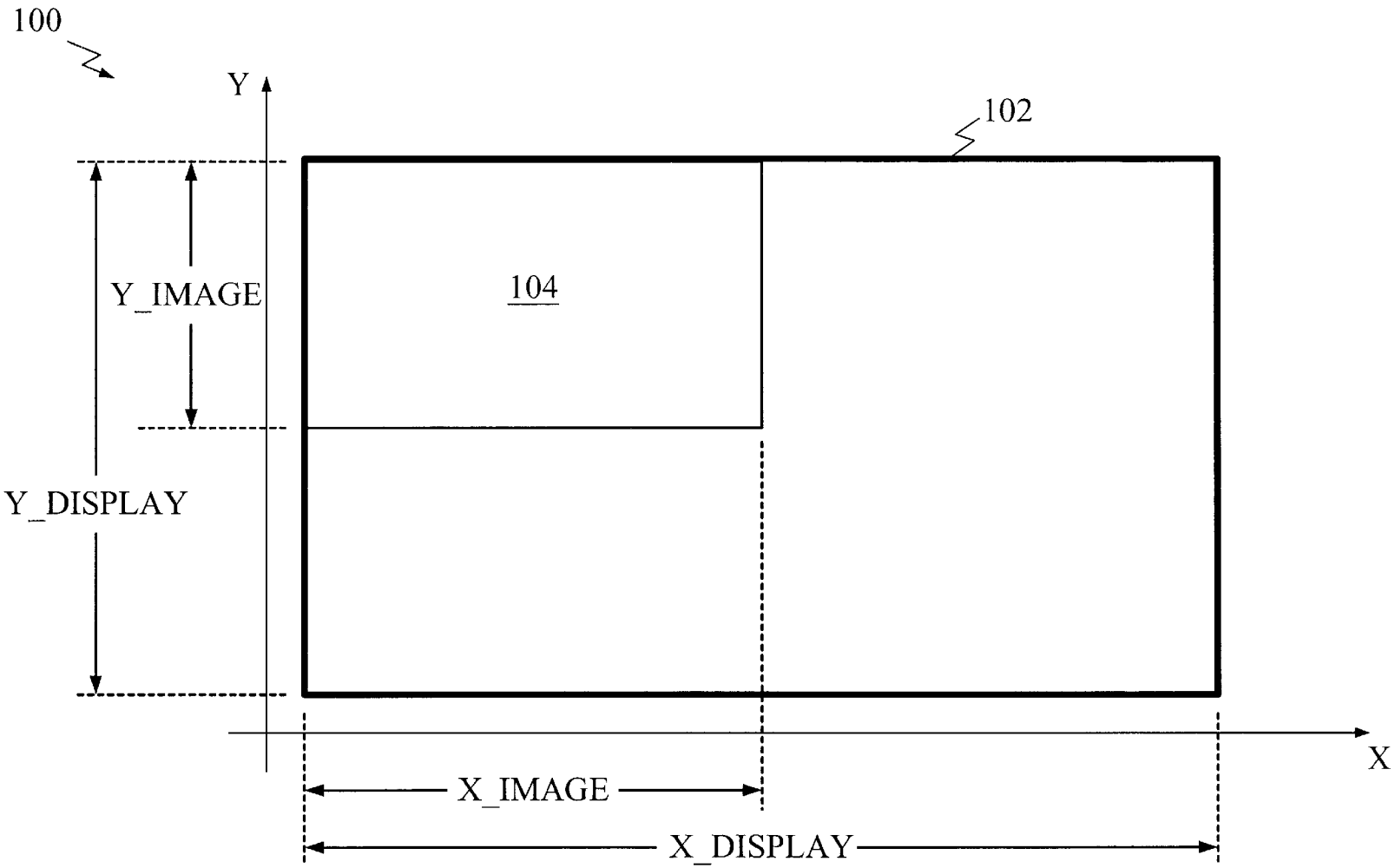
FIG. 1 is an example display output produced using an example disadvantageous display controller arrangement.

Before beginning a detailed description of the present invention, mention of the following is in order. When appropriate, like reference numerals and characters may be used to designate identical, corresponding or similar components in differing figure drawings. Further, in the detailed description to follow, example values and ranges may be given, although the present invention is not limited to the same.

Overview of the Present Invention

Display controllers retrieve an image from memory, process the image data, and then send it on to a display device for display to a user. In order to be compatible with legacy VGA software, a display controller may contain a set of VGA registers that may be programmed by the software to control the VGA mode of operation. Each VGA mode may have a different resolution, and therefore the images created by the software program may have varying resolutions.

Many display devices such as multi-sync monitors are equipped to handle images of varying resolution and timing. These display devices lock to the timing and scale and align the image so that the resulting image fits the screen. However, some display devices such as televisions, Liquid Crystal Displays (LCDs) or other flat panel displays have a fixed resolution and timing. The fixed resolution of these display devices often is greater than the resolution of the image. The design of the display controller will affect how the lower resolution image appears on the fixed resolution display device.

In an example disadvantageous arrangement, a display controller includes only a VGA timing generator that is programmed by a VGA software program corresponding to an image generated by the program. FIG. 1 depicts an example display output 100 produced using this disadvantageous display controller. As shown in FIG. 1, a display 102 has a resolution of a number of pixels along the x-axis given by X_DISPLAY and along the y-axis given by Y_DISPLAY. For example, an LCD may have a resolution of 1024×768 pixels (i.e., X_DISPLAY=1024, Y_DISPLAY=768). Similarly, an image 104 has a resolution of a number of pixels along the x-axis given by X_IMAGE and along the y-axis given by Y_IMAGE. For example, a VGA image may have a resolution of 640×480 pixels (i.e., X_IMAGE=640, Y_IMAGE=480).

As shown in FIG. 1, using the disadvantageous display controller may result in a non-display-filling image 104 that is aligned within display 102 in a manner that would be to distracting to a user, such as in the upper left hand corner. This misalignment and/or non-coincidence in size results because the VGA timing generator is programmed corresponding to the image which has a resolution and timing that is different from that of the display device. Having image 104 centered within display 102 may be a more advantageous result, i.e., more pleasing to the user of the display device.

A display controller according to an example embodiment of the present invention, for example, aligns image 104 such that it is displayed in the center of the display surrounded by a border region. This advantageous arrangement includes a first timing generator, referred to herein as the VGA timing generator (TG), that is programmed corresponding to the image. This display controller also includes a second timing generator, referred to herein as the display TG, that is programmed corresponding to resolution and timing of the display device.

Figure 2:
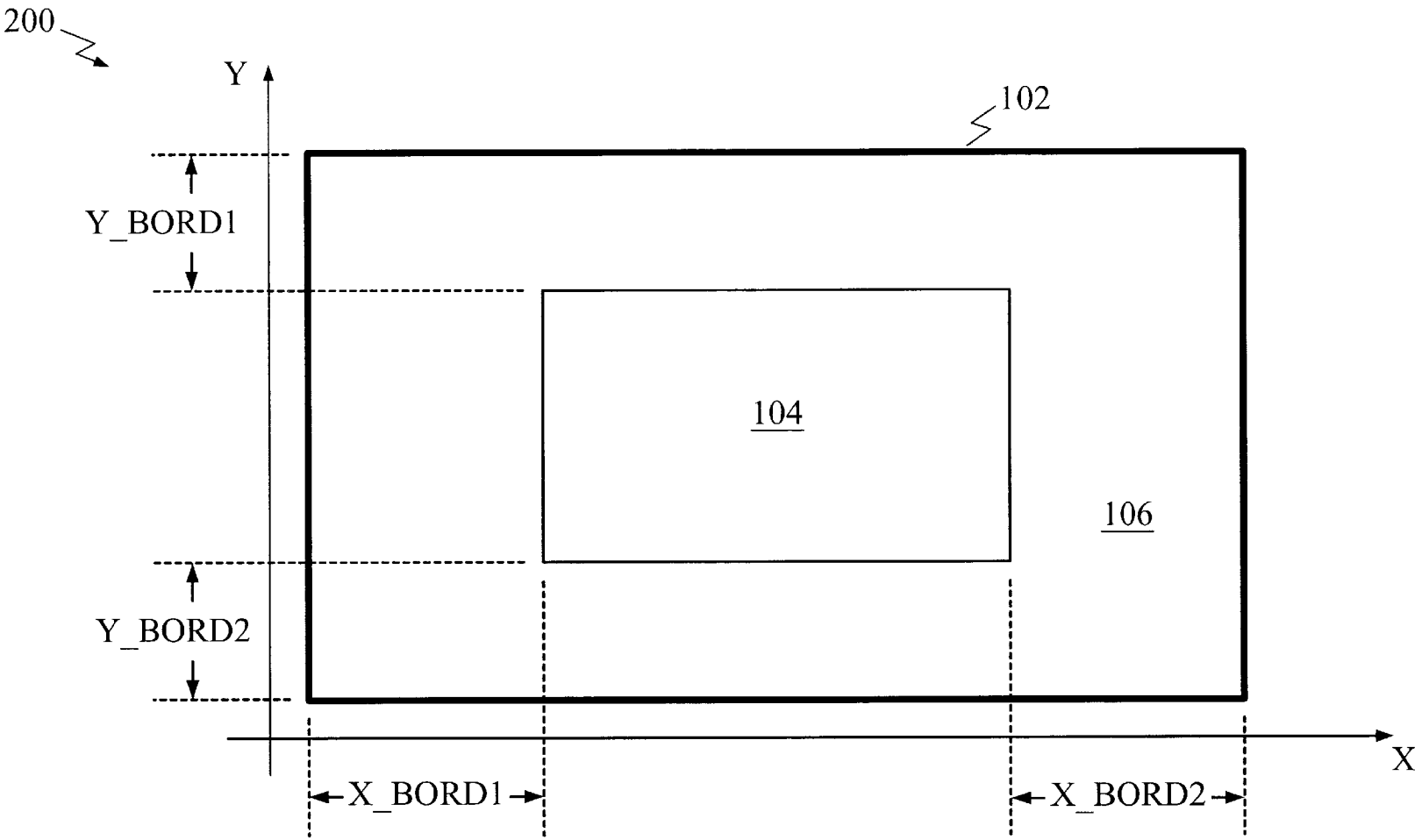
FIG. 2 is an example display output produced using a display controller according to an example embodiment of the present invention.

The display TG determines the appropriate border region based on the resolutions of the image and display device. FIG. 2 depicts an example display output 200 produced using a display controller according to an example embodiment of the present invention, where image 104 is surrounded by a border region 106. The display TG accesses one or more registers that control the VGA TG to capture data stored therein that is indicative of the resolution of the image. The display TG uses this data to determine the image resolution (X_IMAGE×Y_IMAGE). The display TG then determines the values shown in FIG. 2 that define border region 106 using the image and display resolutions: X_BORD1, X_BORD2, Y_BORD1, and Y_BORD2. If image 104 is to be centered within display 102, then X_BORD1=X_BORD2 and Y_BORD1=Y_BORD2. However, according to other example embodiments of the present invention, image 104 may be aligned in a manner that is not exactly centered, but is nevertheless desirable for some other reason. In this case X_BORD1≠X_BORD2 and Y_BORD1≠Y_BORD2.

The display TG, which is programmed corresponding to the display device, provides the timing control for the display device. The display TG causes the border region to be displayed, and then triggers the VGA TG at the appropriate time to cause the image to be displayed on the display device. The operation of the two timing generators according to this example embodiment of the present invention results in the image being displayed in the center of the display device

Overview of the Environment

Figure 3:
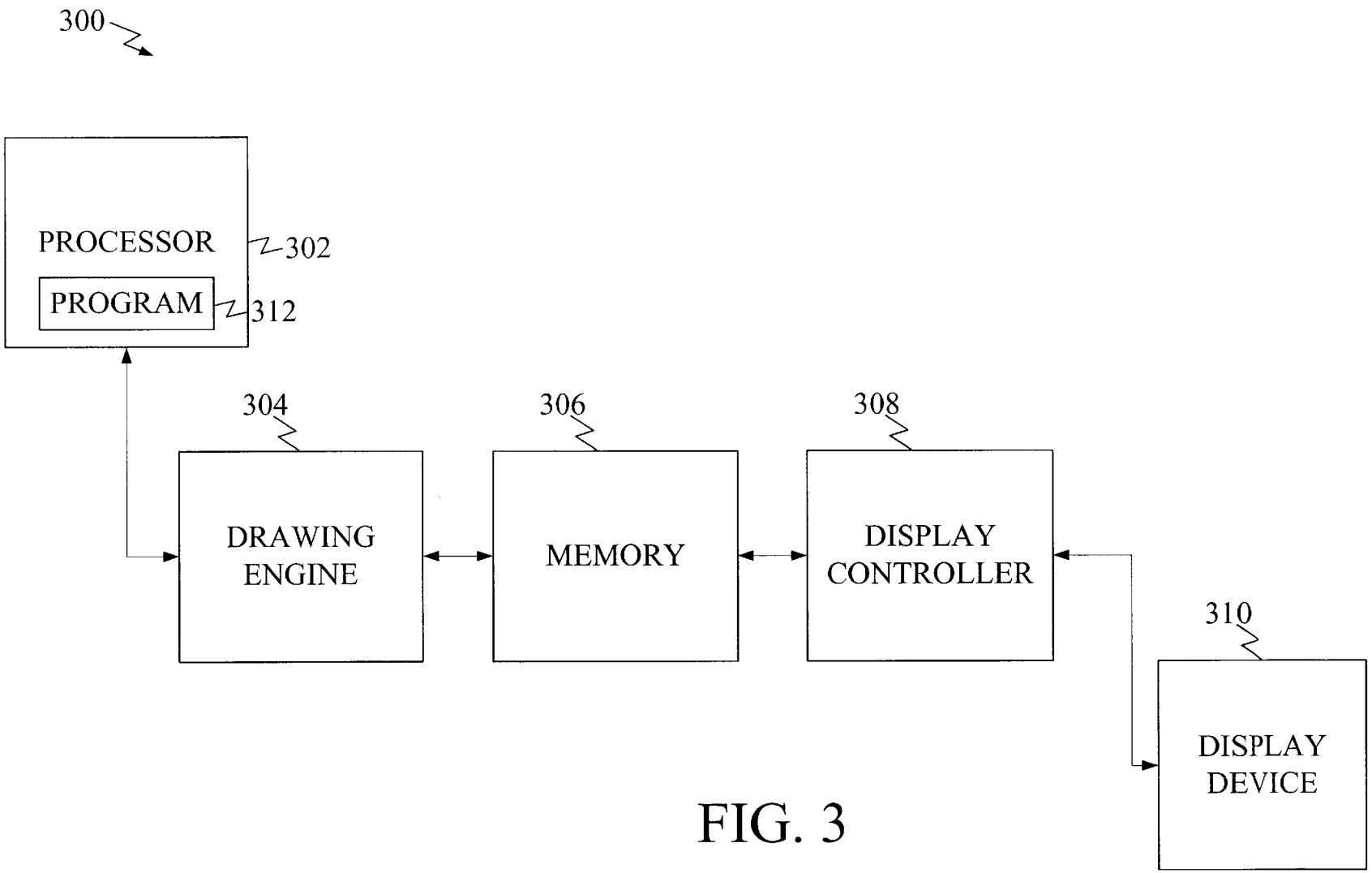
FIG. 3 is a block diagram that depicts an example graphics environment within which the present invention operates.

FIG. 3 depicts an example graphics environment 300 within which an example embodiment of the present invention operates. A processor 302 operates under the control of a computer program 312, which can include, for example, applications that produce various images 104. A drawing engine 304 creates the images under the control of processor 302 and stores them in a memory 306. A display controller 308 retrieves the images from memory 306 and provides the image data to a display device 310. Display device 310 produces display 102 for a user (not shown). The arrows representing communications between the various elements of example graphics environment 300 can represent varying communication paths, such as direct lines between the communicating elements, communications via a computer bus (not shown), or communications via an intermediate element.

Processor 302 may represent any computer processor capable of interacting with drawing engine 304 to produce image 104 in memory 306. For example, processor 302 may represent a digital signal processor (DSP), a microcontroller, an application specific integrated circuit (ASIC), or a microprocessor. Specifically, processor 302 may represent a processing system based on the PENTIUM®II, PENTIUM®III, and CELERON® microprocessors available from Intel Corporation. Processor 302 may also represent other processors in various systems, including personal computers (PCs) having other microprocessors, engineering workstations, and set-top boxes may also be used.

Program 312 may represent any computer program that generates images 104 for display on display device 310. For example, program 312 may represent business software that produces charts and graphs, a game that produces high-resolution images, or a browser that downloads various images from the Internet. Further, images 104 may represent varying standards, such as VGA, Enhanced Graphics Array (EGA), and Super VGA (SVGA). VGA images 104 may include images generated according to the various VGA modes.

Drawing engine 304, under the control of program 312, creates image 104 and stores it in memory 306. Memory 306 may store instructions and/or data. Memory 306 may represent any storage media or device (e.g., random access memory (RAM), hard disk drive, floppy disk drive, read only memory (ROM), CD-ROM device, flash memory device, digital versatile disk (DVD), or other storage device) readable/writeable by a general or special purpose programmable processing system.

Display controller 308 may retrieve one or more images 104 from memory 306, process the image data, and then send the image data on to display device 310 for display to the user. Display controller 308 is described in greater detail in the following section.

Display device 310 may represent, for example, a cathode ray tube (CRT) device, an LCD or other flat panel display, a television, or other analog or digital displays. These devices vary in resolution, and in the types of timing control they require. Display device 310 may also represent whatever interface the display requires to translate data received from display controller 308. For example, display device 310 may represent an LCD encoder connected to an LCD. As a further example, display device 310 may represent a digital-to-analog converter (DAC) connected to an analog monitor.

Display Controller

Figure 4:
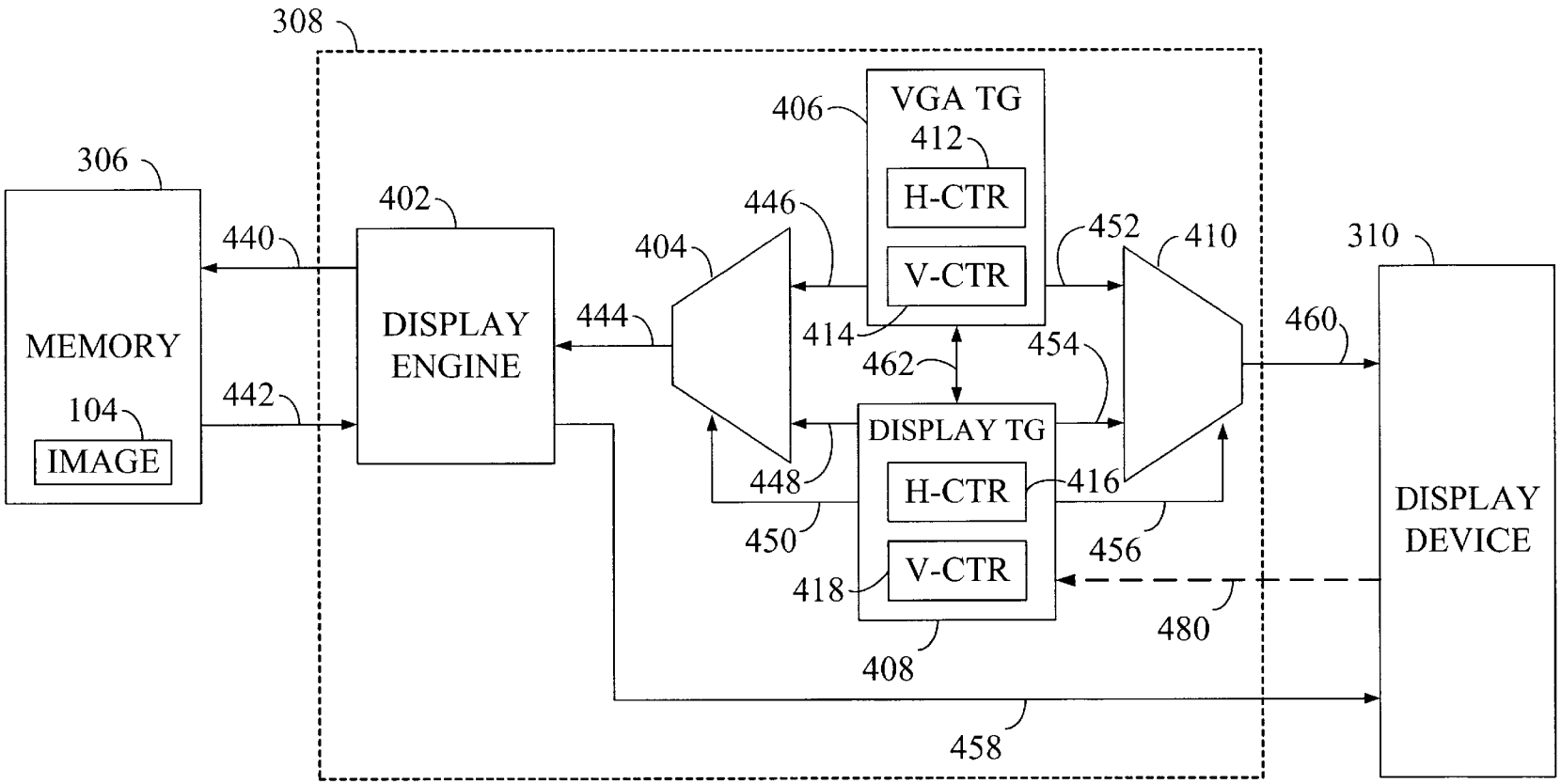
FIG. 4 is an example block diagram that depicts display controller in greater detail according to an example embodiment of the present invention.

FIG. 4 depicts the example display controller 308 in greater detail according to an example embodiment of the present invention. Display controller 308 includes two timing generators, a VGA TG 406 and a display TG 408, which are coupled to a display engine 402 via a first multiplexer 404. The timing generators are also coupled to display device 310 via a second multiplexer 410. Multiplexers 404 and 410 may be controlled by display TG 408 via lines 450 and 456, respectively. VGA TG 406 includes a horizontal counter (H-CTR) 412 and a vertical counter (V-CTR) 414. Display TG 408 also includes a horizontal counter (H-CTR) 416 and a vertical counter (V-CTR) 418.

Display engine 402 may be responsible for taking image data from memory 306 and presenting it in a format acceptable to display device 310. Display engine 402 passes information, such as addresses and data, to memory 306 via line 440. Memory 306 returns the image data to display engine 402 via line 442. Display engine 402 may perform standard VGA functions and may be capable of driving VGA display devices. Display engine 402 may also include extensions to support 800×600, 1280×1024, and 1600×1200 resolutions with 8, 16, and 24 bits per pixel, or any other number/types of predetermined arrangements. The actual modes supported may be limited by the available amounts of memory, maximum clock rate, and the available bandwidth of the system. Display engine 402 may support SVGA as well as VGA. The display engine may also be extended to generate television timing and sync signals, such as for the NTSC and PAL standards.

Timing generators, including VGA TG 406 and display TG 408, may provide the basic timing control for displaying an image on a display device. The timing control varies according to the particular display device, but often includes horizontal count resolution (eight or nine dots/character), various dot clocks and their divide down cousins, and the video loading circuitry, which determines whether data should be loaded at every 8-, 16-, or 32-dot clock.

The graphics functions of VGA TG 406 may be controlled through one or more registers (not shown) associated with the timing generator. The VGA standard dictates the placement and function of the register set associated with VGA TG 406, referred to herein as VGA registers. Programs 312 which adhere to the VGA standard control the graphics functions of VGA TG 406 by accessing the VGA registers. These VGA registers are mapped into the host port address space and may be accessed via assembly language IN and OUT instructions. VGA registers may be one byte wide and segmented into one to eight independent fields.

Similarly, the functions of display TG 408 may be controlled through one or more registers (not shown) associated with the display TG. While these registers may be accessed by programs during execution, programs using the VGA standard will access the VGA registers instead.

Programming a timing generator refers to setting up the registers associated with the timing generator so that the timing generator provides desired timing control. The registers associated with a timing generator may, for example, be programmed corresponding to a particular display device 310. In this case the registers are set up so that the timing generator provides timing control appropriate to the particular display device. A subset of the registers associated with a timing generator may be programmed so that a subset of the timing control signals are properly generated. For example, a certain subset of the registers associated with a timing generator may be programmed corresponding to a particular resolution, so that a subset of the timing control signals (e.g., image data enable, border data enable, and blank enable signals) are properly generated.

The registers associated with VGA TG 406 and display TG 408 may be programmed by any process within processor 302 such as program 312, the operating system (not shown), or the video basic input/output system (video BIOS), though legacy VGA programs will not program the display TG 408. However, VGA programs may program VGA TG 406 one or more times during program execution.

Timing generators may provide the timing control necessary to display images on display device 310. For example, a timing generator provides timing control to display engine 402 in order to direct the display engine to take image data from memory 304 and present it in a format acceptable to display device 310. Those timing control signals passed between the timing generators and display engine 402 are collectively represented as line 444. Both timing generators, VGA TG 406 and display TG 408, produce these timing control signals (though the timing control may differ if the TGs are programmed differently) collectively represented as lines 446 and 448, respectively. Multiplexer 404, under the control of display TG 408, for example, selects which of the signals on lines 446 and 448 make up the collection of signals represented by line 444. For example, multiplexer 404 may select an image data enable signal from VGA TG 406, and the remaining timing control signals from display TG 408.

The timing generators may also provide timing control directly to display device 310 via multiplexer 410. For example, sync and blanking signals may be provided to display device 310 via multiplexer 410. As with multiplexer 404, multiplexer 410 (under the control of display TG 408, for example) selects certain of the timing control signals from lines 452 and 454. The signals selected by multiplexer 410 are collectively represented as line 460.

The horizontal counters (H-CTR 412 and 416) and vertical counters (V-CTR 414 and 418) may be used by the timing generator to, among other things, generate several enable signals that are provided to display engine 402. For example, the image data enable signal is asserted when the horizontal and vertical counts are within the region where image 104 is to be displayed within display 102.

Operation

Figure 5:
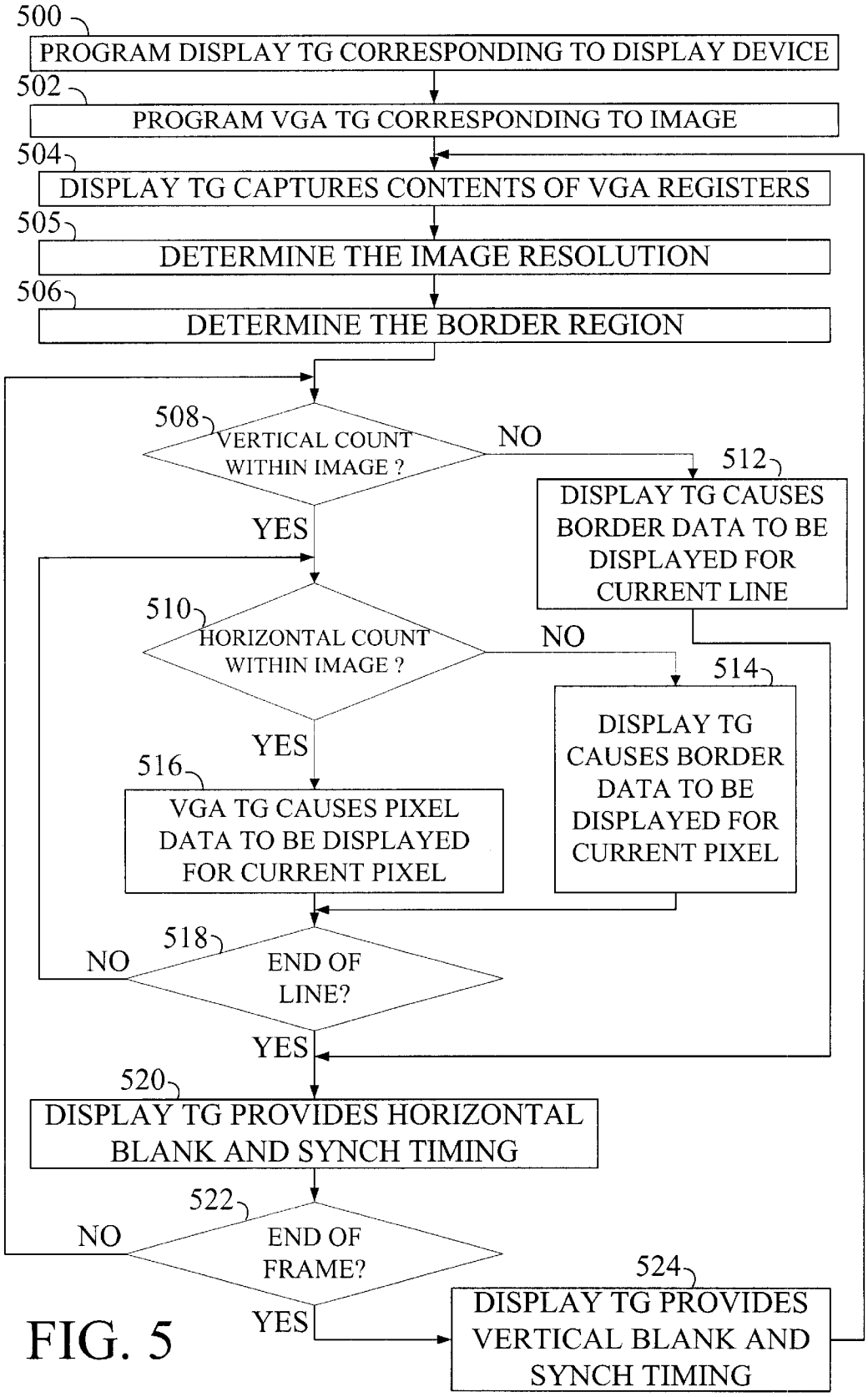
FIG. 5 is an example flowchart that describes the operation of a display controller according to an example embodiment of the present invention.

FIG. 5 depicts an example flowchart that describes an example operation of display controller 308 according to an example embodiment of the present invention. The operations depicted in FIG. 5 describe how display controller 308 aligns an image 104 such that it is displayed in the center of a fixed resolution display device 310 surrounded by border region 106.

In operation 500, display TG 408 may be programmed corresponding to display device 310. According to an example embodiment of the present invention, display TG 408 is programmed during processor 302 power-up. The video BIOS (not shown) determines the type of display device 310, and then programs display TG 408 accordingly. Display TG 408 may not need to be re-programmed so long as display device 310 remains unchanged.

According to an example embodiment of the present invention, display TG 408, rather than VGA TG 406, provides one or more of the timing control signals for display device 310. Since display TG 408 is programmed corresponding to display device 310, display TG 408 may provide timing control signals according to the specifications of display device 310. For example, many LCDs may be unable to operate or may have their lives shortened if they are sent frame rates greater than 60 Hz. Many of the VGA modes that VGA TG 406 may be programmed to have frame rates of 70 Hz, whereas display TG 408, being programmed to the LCD, will provide the expected 60 Hz. Display TG 408 therefore protects display device 310 against timing control that could cause damage or shorten the display's life. As an additional example, televisions may not operate at all if the timing control they expect is not provided. As with LCDs, VGA TG 408 programmed to a VGA mode may not provide this timing control, whereas display TG 408 will provide the expected television timing control.

Further, display controller 308 may handle other features of the various VGA modes of operation, such as pixel doubling. According to an example embodiment of the present invention, the half-rate clock signals dictated by the pixel doubling mode are sent to display engine 402 (by VGA TG 406 or display TG 408), while clocking signals sent to display device 310 are sent at the display's native rate.

In operation 502, VGA TG 408 is programmed corresponding to image 104 stored in memory 306. According to an example embodiment of the present invention, program 312 may represent a VGA application that programs VGA TG 408 one or more times during program execution. In this embodiment, operation 502 may therefore be repeated intermittently and not necessarily in the order of operation depicted in FIG. 5.

In operation 504, display TG 408 captures the contents of one or more VGA registers that contain data indicative of the resolution of image 104, for example, via line 462. Once VGA TG 408 is programmed corresponding to image 104 in operation 504, the VGA registers will contain data that is indicative of the resolution of image 104.

In operation 505, display TG 408 determines the resolution of image 104 using the data captured in operation 504. According to an example embodiment of the present invention, the resolution of image 104 is determined according to the following example formula:

X_IMAGE=(((CR01+1)<<3)+(SR01?(CR01+1):0))<<(PIXEL_DBL?1:0)

where CR01 represents the value stored in the Horizontal Display End Register in the VGA register set, SR01 represents the value stored in the Clocking Mode Register in the VGA register set, and PIXEL_DBL represents whether the pixel doubling function has been set for the current mode of operation. The value for Y_IMAGE may be calculated in similar fashion by accessing the value stored in the Vertical Display End Register in the VGA register set.

In operation 506, display TG 408 uses this resolution data to determine border region 106. For a centered image 104, the following example formulas may be used to determine border region 106:

X_BORD1=X_BORD2=(X_DISPLAY−X_IMAGE)/2 (in pixels),

Y_BORD1=Y_BORD2=(Y_DISPLAY−Y_IMAGE)/2 (in pixels), where X_DISPLAY and Y_DISPLAY represents the fixed resolution of display device 310.

According to other example embodiments of the present invention different formulas may be used for particular configurations of registers.

For the example embodiment described by operations 508 through 524, image 104 may represent one or more frames of image data stored in memory 306, where each frame is drawn within display 102 one pixel at a time, tracing across each horizontal line beginning with the top line of display 102 and working down. Other example embodiments may draw pixels in a different order, say on a column-by-column basis or an interlaced fashion. Operations 508 through 524 may be modified according to these other example embodiments to account for the order in which the pixels are drawn, but will still operate in substantially the same manner as depicted in FIG. 5.

Display TG 408 keeps track of which pixel in display 102.is being displayed at any given time using H-CTR 416 and V-CTR 418. According to an example embodiment of the present invention, the count in V-CTR 418 (referred to herein as the vertical count) indicates the line currently being displayed, whereas the count in H-CTR 416 (referred to herein as the horizontal count) indicates which pixel within the current line is being displayed. H-CTR 416 increments the vertical count when the horizontal count reaches X_DISPLAY.

In operation 508, it is determined whether the vertical count is within the portion of display 102 where image 104 is to be displayed. According to an example embodiment of the present invention, display TG 408 monitors the vertical count and determines that image 104 should be displayed when the vertical count reaches the size of Y_BORD1. Similarly, display TG 408 determines that border region 106 should again be displayed when the vertical count reaches the size of Y_BORD1+Y_IMAGE.

If the vertical count is determined to be within border region 106 rather than image 104, then in operation 512 display TG 408 causes border data to be displayed for the current line. For example, at the beginning of a new frame, the first horizontal line is within border region 106 (assuming that image 104 is to be centered within display 102 and that the resolution of the image is less than that of the display). Once display TG 408 determines that the vertical counter is within border region 106, then the entire line may be displayed. Display TG 408 directs display engine 402 to output border data for the current line by providing the appropriate timing control to display engine 402. Multiplexer 404, under the control of display TG 408, enables the appropriate signals from line 448 so that they may be passed to display engine 402 via line 444. According to an example embodiment of the present invention, the border data is represented by a single color, so that border region 106 when displayed appears to be a solid single-color border surrounding image 104.

Once display engine 402 has output border data for the current line in operation 512, in operation 520 display TG 408 provides the appropriate horizontal blank and sync timing to display device 310. Multiplexer 410, under the control of display TG 408, enables the appropriate signals from line 454 so that they may be passed to display device 310 via line 460. This ends the current horizontal line, so V-CTR 418 is incremented.

Returning the discussion now to operation 508, if the vertical count is determined to be within image 104, then in operation 510 it is further determined whether the horizontal count is within the portion of display 102 where image 104 is to be displayed. According to an example embodiment of the present invention, display TG 408 monitors the horizontal count and determines that image 104 should be displayed when the horizontal count reaches the size of X_BORD1. Similarly, display TG 408 determines that border region 106 should again be displayed when the horizontal count reaches the size of X_BORD1+X_IMAGE. According to a second embodiment of the present invention, display TG 408 determines that border region 106 should again be displayed when VGA TG 406 finishes displaying the current line of image 104 and negates the image data enable signal on line 446.

If the horizontal count is determined to be within border region 106 rather than image 104, then in operation 514 display TG 408 causes border data to be displayed for the current pixel. Display TG 408 directs display engine 402 to output border data to display device 310 for the current pixel by providing the appropriate timing control. Multiplexer 404, under the control of display TG 408, enables the appropriate signals from line 448 so that they may be passed to display engine 402 via line 444.

If the horizontal count is determined to be within image 104, then in operation 516 display TG 408 triggers VGA-TG 406 to begin displaying image 104. According to an example embodiment of the present invention, display TG 408 triggers H-CTR 412 within VGA TG 406 via line 462. Multiplexer 404, under the control of display TG 408, selects the image data enable from VGA TG 406 on line 446, and the remaining timing control signals from display TG 408 on line 448. This combination of timing control on line 444 causes display engine 402 to output image data for the current pixel. H-CTR 412 and V-CTR 414 operate in much the same way as H-CTR 416 and V-CTR 418 described with respect to display TG 408, except that the counters in VGA TG 406 are programmed corresponding to image 104. An end of line may therefore be detected when the count in H-CTR 412 reaches the size of X_IMAGE, and an end of frame when the count in V-CTR 414 reaches the size of Y_IMAGE.

Once either operation 514 or 516 have completed, in operation 518 it is determined whether the end of the current horizontal line has been reached. According to an example embodiment of the present invention, this occurs when the horizontal count reaches the size of X_DISPLAY. If the end of the line has not been reached, the horizontal count is incremented and tested again in operation 510, and the loop represented by operations 510, 514, 516, and 518 is repeated until the end of the current horizontal line is reached. If the end of the line has been reached, the vertical count is incremented, and in operation 520 display TG 408 provides the appropriate horizontal blank and sync timing to display device 310. Multiplexer 410, under the control of display TG 408, enables the appropriate signals from line 454 so that they may be passed to display device 310 via line 460.

In operation 522, it is determined whether the end of the current frame has been reached. According to an example embodiment of the current invention, the end of the current frame is reached when the vertical counter reaches the size of Y_DISPLAY. If the end of the frame has not been reached, then the vertical count is again tested in operation 508 and the loop represented by operations 508 through 520 repeats until the end of the frame is reached. If the end of the current frame has been reached, then in operation 524 display TG provides the appropriate vertical blank and sync timing to display device 310. Multiplexer 410, under the control of display TG 408, enables the appropriate signals from line 454 so that they may be passed to display device 310 via line 460.

Once the current frame is complete, in operation 504 display TG 504 again captures the contents of the VGA registers within VGA TG 406 to determine the resolution of the current image 104 stored in memory 306. As described above, a VGA program may re-program VGA TG 406 one or more times during execution. According to an example embodiment of the present invention, display TG 408 in effect samples the resolution of VGA TG 406 once per frame. According to other embodiments, display TG 408 samples the resolution of VGA TG 406 more or less often.

This concludes the description of the example embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

For example, while the above example discussions describe display TG 408 being set during system initialization due to a pre-programming of the BIOS, display TG 408 may instead be set directly by display device 310 as indicated generically by the FIG. 4 dashed arrow 480. Further, it should be noted that any portion of display controller 308 may be implemented in hardware (e.g., for speed) or software (e.g., for versatility).

In addition, while the above example discussions suggest that the border sizes (e.g, equal borders) are determined automatically by display controller 308 (e.g., according to a predetermined border scheme), display controller 308 of course may be adapted (e.g., via suitable programming) to allow user overriding of the predetermined border scheme, for example, to allow adjustment for user preferences.

As yet another example, an additional strobe (not shown) may be used to qualify actual source data. The strobe may be used to distinguish pseudo border data from image data and, thus, image data can be processed for display device requirements.

What is claimed is:

1. A controller for displaying on a display device an image stored in a memory and a border region, wherein the image has a first resolution and the display device has a second resolution different from the first resolution, the controller comprising:

a display engine coupled between the memory and the display device;

a first timing generator which directs the display engine to output image data to display the image on the display device;

one or more registers which control the first timing generator, wherein the one or more registers store data indicative of the first resolution; and a second timing generator which determines the first resolution using the data, determines the border region using the first resolution and the second resolution, and directs the display engine to display the border region on the display device and provides timing information to the display device;

wherein the border region includes an X border count and a Y border count, the first resolution includes a horizontal dimension (X_image) and a vertical dimension (Y_image), the second resolution includes a horizontal dimension (X_display) and vertical dimension (Y_display), and wherein the second timing generator determines the X border count and the Y border count based on the following formulas:

X border count is substantially equal to (X display−X image) divided by 2, and

Y border count is substantially equal to (Y display−Y image) divided by 2.

2. The controller as claimed in claim 1, wherein the first timing generator comprises a first horizontal counter and a first vertical counter, and the second timing generator comprises a second horizontal counter and a second vertical counter, and wherein the second horizontal counter triggers the first horizontal counter upon reaching the X border count, and wherein the second vertical counter triggers the first vertical counter upon reaching the Y border count.

3. A method for displaying on a display device an image stored in a memory and a border region, wherein the image has a first resolution and the display device has a second resolution different from the first resolution, the method comprising:

programming a second timing generator corresponding to the display device;

programming a first timing generator corresponding to the image;

capturing data indicative of the first resolution from one or more registers used to control the first timing generator;

determining the first resolution using the data;

determining the border region using the first resolution and the second resolution;

enabling the first timing generator to cause the image to be displayed on the display device; and enabling the second timing generator to cause the border region to be displayed on the display device and to provide timing information to the display device;

wherein the border region comprises an X border count and a Y border count, the first resolution comprises a horizontal dimension (X_image) and a vertical dimension (Y_image), the second resolution comprises a horizontal dimension (X_display) and vertical dimension (Y_display), and the determining the border region comprises determining the X border count and the Y border count based on the following formulas:

X border count is substantially equal to (X display−X image) divided by 2, and

Y border count is substantially equal to (Y display−Y image) divided by 2.

4. The method as claimed in claim 3, wherein the first timing generator comprises a first horizontal counter and a first vertical counter, and the second timing generator comprises a second horizontal counter and a second vertical counter, and wherein the enabling of the first timing generator to cause the image to be displayed on the display device comprises triggering the first horizontal counter upon the second horizontal counter reaching the X border count, and triggering the first vertical counter upon the second vertical counter reaching the Y border count.

5. A controller for displaying on a display device an image stored in a memory and a border region, wherein the image has a first resolution and the display device has a second resolution different from the first resolution, the controller comprising:

a display engine coupled between the memory and the display device;

a first timing generator which directs the display engine to display the image on the display device;

one or more registers which control the first timing generator, wherein the one or more registers store data indicative of the first resolution; and a second timing generator which determines the first resolution using the data at least once per frame, determines the border region using the first resolution and the second resolution, directs the display engine to display the border region on the display device and provides timing information to the display device, wherein the border region comprises an X border count and a Y border count, the first resolution comprises a horizontal dimension (X_image) and a vertical dimension (Y_image), the second resolution comprises a horizontal dimension (X_display) and vertical dimension (Y_display), and wherein the second timing generator determines the X border count and the Y border count based on the following formulas:

X border count is substantially equal to (X_display−X_image) divided by 2, and

Y border count is substantially equal to (Y_display−Y_image) divided by 2.

6. The controller as claimed in claim 5, wherein the first timing generator comprises a first horizontal counter and a vertical counter, and the second timing generator comprises a second horizontal counter and a second vertical counter, and wherein the second horizontal counter triggers the first horizontal counter upon reaching the X border count, and wherein the second vertical count triggers the first vertical counter upon reaching the Y border count.

7. A method for displaying on a display device an image stored in a memory and a border region, wherein the image has a first resolution and the display device has a second resolution different from the first resolution, the method comprising:

programming a second timing generator corresponding to the display device;

programming a first timing generator corresponding to the image;

capturing data indicative of the first resolution from one or more registers used to control the first timing generator, at least once per frame;

determining the first resolution using the data;

determining the border region using the first resolution and the second resolution;

enabling the first timing generator to cause the image to be displayed on the display device; and enabling the second timing generator to cause the border region to be displayed on the display device and to provide timing information to the display device, wherein the border region comprises an X border count and a Y border count, the first resolution comprises horizontal dimension (X_image) and vertical dimension (Y_image), the second resolution comprises a horizontal dimension (X_display) and vertical dimension (Y_display), and the determining the border region comprises determining the X border count and the Y border count based on the following formulas:

X border count is substantially equal to (X display−X image) divided by 2, and

Y border count is substantially equal to (Y display−Y image) divided by 2.

8. The method as claimed in claim 7, wherein the first timing generator comprises a first horizontal counter and a first vertical counter, and the second timing generator comprises a second horizontal counter and second vertical counter, and wherein the enabling the first timing generator to cause the image to be displayed on the display device comprises triggering the first horizontal counter upon the second horizontal counter reaching the X border count, and triggering the first vertical counter upon the second vertical counter reaching the Y border count.

9. An apparatus for displaying on a display device an image stored in a memory and a region, wherein the image has a first resolution and the display device has a second resolution different from the first resolution, comprising:

a display engine in communication with the memory and the display device; and a first timing circuit which determines the first resolution using data indicative of the first resolution, determines the region using the first resolution and the second resolution, and directs the display engine to display the region on the display device and provides timing information to the display device;

wherein the region includes an X count and a Y count, the first resolution includes a horizontal image dimension and a vertical image dimension, the second resolution includes a horizontal display dimension and vertical display dimension, and wherein the first timing circuit determines the X count and the Y count.

10. The apparatus as claimed in claim 9, further comprising:

a second timing circuit which directs the display engine to output image data to display the image on the display device.

11. The apparatus as claimed in claim 10, further comprising:

one or more registers which control the second timing circuit, wherein the one or more registers store data indicative of the first resolution.

12. The apparatus as claimed in claim 10, wherein the first timing circuit comprises a first horizontal counter and a first vertical counter and the second timing circuit comprises a first horizontal counter and a first vertical counter, wherein the first horizontal counter triggers the second horizontal counter upon reaching the X count, and wherein the first vertical counter triggers the second vertical counter upon reaching the Y count.

13. The apparatus as claimed in claim 10, wherein the second timing circuit is programmed corresponding to the image.

14. The apparatus as claimed in claim 10, wherein the image is generated by an application, the first timing circuit is programmed at power-up, and the second timing generator is programmed by the application.

15. The apparatus as claimed in claim 9, wherein the region comprises a border region.

16. The apparatus as claimed in claim 9, wherein the image comprises a sequence of frames, and wherein the first timing circuit determines the region after each of the frames.

17. The apparatus as claimed in claim 9, wherein the first timing circuit captures the data during a vertical blank time.

18. The apparatus as claimed in claim 9, wherein the first timing circuit is programmed corresponding to the display device.

19. The apparatus as claimed in claim 9, wherein the display device comprises an LCD, the image comprises a VGA image, the first resolution is 640×480 pixels and the second resolution is 1024×768 pixels.

20. A method for displaying on a display device an image stored in a memory and a region, wherein the image has a first resolution and the display device has a second resolution different from the first resolution, comprising:

determining the first resolution using data indicative of the first resolution;

determining the region using the first resolution and the second resolution;

directing a display engine to display the region on the display device and providing timing information to the display device;

defining the region including an X count and a Y count;

defining the first resolution including a horizontal image dimension and a vertical image dimension;

defining the second resolution including a horizontal display dimension and vertical display dimension; and determining the X count and the Y count.

21. The method as claimed in claim 20, further comprising:

directing the display engine to output image data to display the image on the display device.

22. The method as claimed in claim 21, further comprising:

storing data indicative of the first resolution.

23. The method as claimed in claim 20, wherein the region comprises a border region.

24. The method as claimed in claim 20, wherein the image comprises a sequence of frames, and further comprising:

determining the region after each of the frames.

25. The method as claimed in claim 20, further comprising:

capturing the data during a vertical blank time.

* * * * *